United States Patent [19]

Ambrose

[11] Patent Number: 4,596,111

[45] Date of Patent: Jun. 24, 1986

[54] APPARATUS AND METHOD FOR PACKAGING DELICATE ARTICLES

[76] Inventor: Charles J. Ambrose, 2230 Benton St., Richland, Wash. 99352

[21] Appl. No.: 508,353

[22] Filed: Jun. 27, 1983

[51] Int. Cl.[4] ..... B65B 31/00

[52] U.S. Cl. ..... 53/434; 53/170; 53/449; 53/512; 53/553; 53/555

[58] Field of Search ..... 53/170, 172, 403, 434, 53/449, 472, 512, 553, 555; 383/3; 493/195, 200, 217, 256, 933; 206/522

[56] References Cited

U.S. PATENT DOCUMENTS

| | | | |
|---|---|---|---|
| 3,325,071 | 6/1967 | Schmitz | 53/172 X |
| 3,340,669 | 9/1967 | Farquharson | 53/472 X |
| 3,386,604 | 6/1968 | Fields | 53/449 X |
| 3,763,622 | 10/1973 | Stanley, Jr. | 53/449 X |
| 3,850,084 | 11/1974 | Fowler et al. | 53/449 X |
| 4,103,471 | 8/1978 | Lowdermilk | 53/512 X |
| 4,190,158 | 2/1980 | Ambrose | 206/522 |

FOREIGN PATENT DOCUMENTS

| | | | |
|---|---|---|---|
| 1112944 | 8/1961 | Fed. Rep. of Germany | 53/434 |
| 670200 | 4/1952 | United Kingdom | 53/512 |
| 855313 | 11/1960 | United Kingdom | 53/434 |

*Primary Examiner*—John Sipos
*Assistant Examiner*—Steven P. Weihrouch
*Attorney, Agent, or Firm*—Robert Keith Sharp

[57] ABSTRACT

A method of packaging an article involves drawing two elongated strips of plastic from a supply, placing an article between them, then drawing two broader sheets above and below the first two sheets. The various sheets are adjusted and sealed in such a manner that two envelopes are formed, one inside the other, the outer envelope being larger in all directions than the inner envelope. The outer envelope is then inflated under conditions such that air is expelled from the inner envelope, collapsing it tightly about the article. By omitting certain steps, an empty container can be formed, suitable for later loading and inflation. The apparatus disclosed automatically carries out the method.

8 Claims, 32 Drawing Figures

APPARATUS AND METHOD FOR PACKAGING DELICATE ARTICLES

INTRODUCTION

This invention is directed to an apparatus and method for forming containers and for automatically packaging articles. When the operations are completed, the container may be empty or one or more articles may be enclosed within an inner envelope which, in turn, is enclosed within an outer envelope. The latter may be inflated so that the inner envelope is suspended in gas, liquid or polymeric foam and spaced from the walls of the outer envelope, but supported at its ends. This provides very good protection for the articles.

BACKGROUND

In my U.S. Pat. Nos. 4,190,158 and 4,267,684 I have disclosed a container for delicate articles substantially as described above and methods for forming the package.

While the package shown in the above patents is very desirable, the methods for its production described therein have been found to be less suited for mass production. It is an object of this invention to provide an apparatus and method which will produce the package described in the above patents in a manner more suitable for automated production.

It is also an object of this invention to provide a similar package in which the outer envelope is filled with a polymeric foam which tightly embraces the article, or in which the outer envelope is filled with a liquid, e.g., water, which may afterwards be frozen.

SUMMARY OF THE INVENTION

The package is formed of four sheets of sheet material supplied from trays. In the first few steps, the article to be packaged is placed between the two inner sheets which will later form the inner envelope. The two outer sheets are then drawn over and under the inner sheets and sealed together, forming the outer envelope. In the subsequent discussion I intend the term "sheets" to include tubes unless the context indicates otherwise. Each tube in that case would constitute two sheets. According to my presently preferred method, however, flat sheets are employed.

According to my presently preferred procedure the package is formed from four sheets of flat heat-sealable plastic material which are supplied in long strips and ordinarily in the form of rolls. The four sheets are superposed during the package-forming operation. For convenience I will term them the 1st, 2d, 3d and 4th sheets, numbering downwardly from the top. The 2d and 3d sheets are materially narrower than the 1st and 4th sheets. Thus the 2d and 3d sheets will form the inner envelope, and the 1st and 4th sheets will form the outer envelope.

In the first step the 3d sheet is drawn from the trays rearwardly into the operating area. (As used in the Specification and claims the term "forwardly" means the direction toward the trays, and "rearwardly" means the opposite direction.) Next, an article to be packaged is placed on this sheet. The 2d sheet is then drawn over the 3d sheet and the article. The 2d and 3d sheets are then sealed together on at least two, and preferably three, sides of the article. It is important that the fourth side, rearward of the article, not be completely sealed. It will be understood that several articles, spaced apart, may be so placed and each partially surrounded by seals. The 1st and 4th sheets are then drawn rearwardly above the 2d sheet and below the 3d sheet, respectively. A gas supply tube is positioned between the 1st and 4th sheets, outside the 2d and 3d sheets. The 1st and 4th sheets are then sealed to each other on three sides, forwardly and at the sides, and all four sheets are sealed together forwardly of the article. The sheets are then cut off ahead of the forward seal.

The positions of the rear edges of the strips are then adjusted so that the rear edges of the 2d and 3d sheets are positioned rearward of those of the 1st and 4th sheets. The 1st and 4th sheets are then sealed to each other transversely rearward of the article except for a small distance, and to the 2d and 3d sheets, the latter two being prevented from being sealed to each other. Air or other gas is then introduced through the gas supply tube between the 1st and 4th sheets at their unsealed portion. This remaining small area is then sealed. It is important that the 2d and 3d sheets have not been sealed together rearward of the article at the time the gas is introduced. This permits the air within the inner envelope formed by those sheets to be expelled during the inflation of the outer envelope, thus collapsing the inner envelope tightly about the packaged article.

Instead of a gas, a foaming polymerizable fluid may be introduced which will expand, inflate the outer envelope, collapse the inner envelope tightly about the article, then polymerize forming a pad which tightly embraces the article. In the following portions of the specification and claims, I use the term "expandable fluid" to include both gases and foams.

Still further, a liquid, e.g., water, might be introduced. The completed package might then be frozen, so that the article, e.g., meat or fish, was refrigerated, but out of contact with the refrigerant. The unmodified "fluid" is used to include liquids.

A liquid, preferably atomized, which will coat the plastic and reduce gas diffusion may be introduced with the gas.

It is usually unnecessary to ever seal the 2d and 3d sheets rearward of the article. However, as a precaution, it may be desirable to do this after all the above steps have been performed. The packaged article is then removed from the work area. The procedure is continuously repeated.

While the above is my preferred procedure, it will be understood that the 2d and 3d sheets may be in the form of a preformed flattened tube and the 1st and 4th sheets as individual flat sheets. In that case, after the tube has been drawn into the working area, the article to be packaged will be placed in the tube, and the inner tube may be sealed forwardly of the article. The 1st and 4th sheets will then be drawn over and under the 2d and 3d sheets, respectively, and sealed together longitudinally near their edges. Subsequent steps will be as described above.

In still another variation of my method, the 1st and 4th sheets may also be in the form of a tube, larger in diameter than that forming the 2d and 3d sheets. In that case, after the article had been placed in the smaller tube, the latter would be sealed forwardly of the article and cut forwardly of the seal. It would then be supported internally while the larger tube was drawn rearwardly over it. The two tubes would then be sealed together forwardly of the article. The outer tube would be cut and the positions of the rear edges adjusted, as described above. The sealing of the rear edges, inflation, and final sealing would proceed as previously described.

If an empty package is desired, the steps of inserting the article, inflation and final sealing would be omitted.

A detailed sequence of steps of my preferred embodiment will be described in the "detailed description".

DETAILED DESCRIPTION

Figure 1:
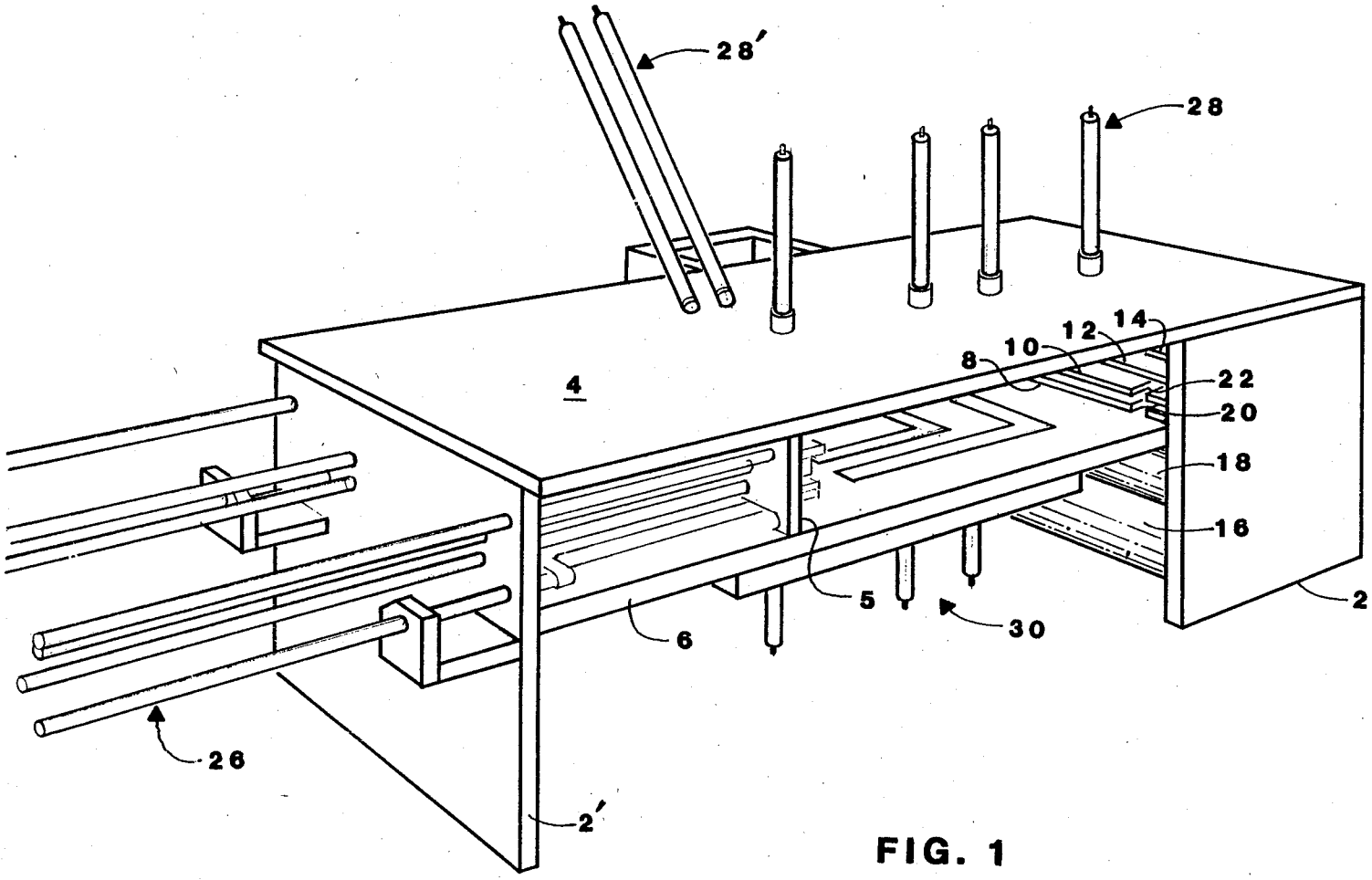
FIG. 1 is a perspective view of the apparatus as a whole.

Referring to the drawings:

FIG. 1 shows the apparatus as a whole which includes support members 2, 2', cover 4 and a working table 6. Each of trays 8, 10, 12 and 14 supplies a sheet of plastic. The plastic is delivered from rolls, of which two are shown at 16 and 18. The trays are provided with notches, two being shown at 20 and 22. These notches are provided to permit the grasping of the plastic by grippers which will be described later. The grippers are supported on pullers carried by rods which as a group are indicated as 26. Rods 26 are slidably mounted in bearings in support 2' and in wall 5, which extends between cover 4 and working table 6. Groups of air cylinders, designated as groups 28 and 28', are located above the cover 4 and extend therethrough, and a similar group designated 30 is located below operating table 6. These air cylinders operate various grippers, cutters and sealers which will be described later. The pullers are operated by similar air cylinders, not shown, between support 2' and wall 5. These cylinders are supplied with air which is controlled by a sequencing system. This system may be computer controlled, and may be mechanical, electrical or pneumatic. This sequencing of the air cylinders provides for the operation which will now be described. Electric wiring (not shown) powers the sealers and a cutter.

Figure 2:
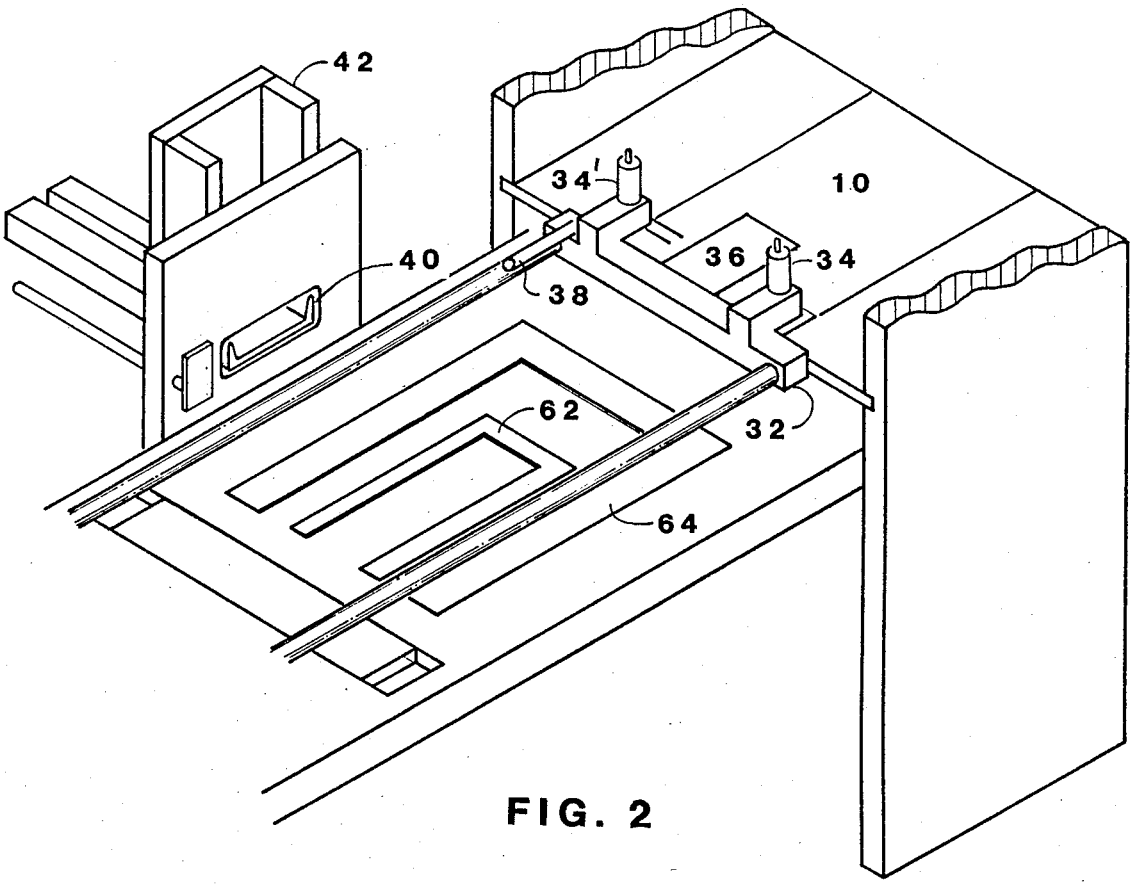
FIGS. 2 and 3 show successive steps in the drawing of a sheet of packaging material and loading the article to be packaged.

In FIG. 1 the pullers are all withdrawn rearwardly, to the left in that figure. (In the description the term "forwardly" will be used to mean the direction toward the trays 8, etc. The term "rearwardly" will mean the direction in which the plastic is drawn). In FIG. 2 a pulling and separating means 32 has been moved forwardly to engage the sheet of plastic on tray 10 (the "3d sheet," using the terminology as applied in the "Summary). It includes grippers, which are operated by small pneumatic cylinders 34, 34', and a separating paddle 36. The function of paddle 36 will be explained later. The grippers serve to grip and hold the plastic. It also carries a supply tube 38 for expandable fluid, the purpose of which will be explained later.

FIG. 2 also shows a delivering means for the articles to be packaged. This includes a feed tray 40 and a stacking means 42. The articles (not shown) are arranged in a stack in means 42 with the lowermost resting in a trough on the tray 40.

Figure 3:
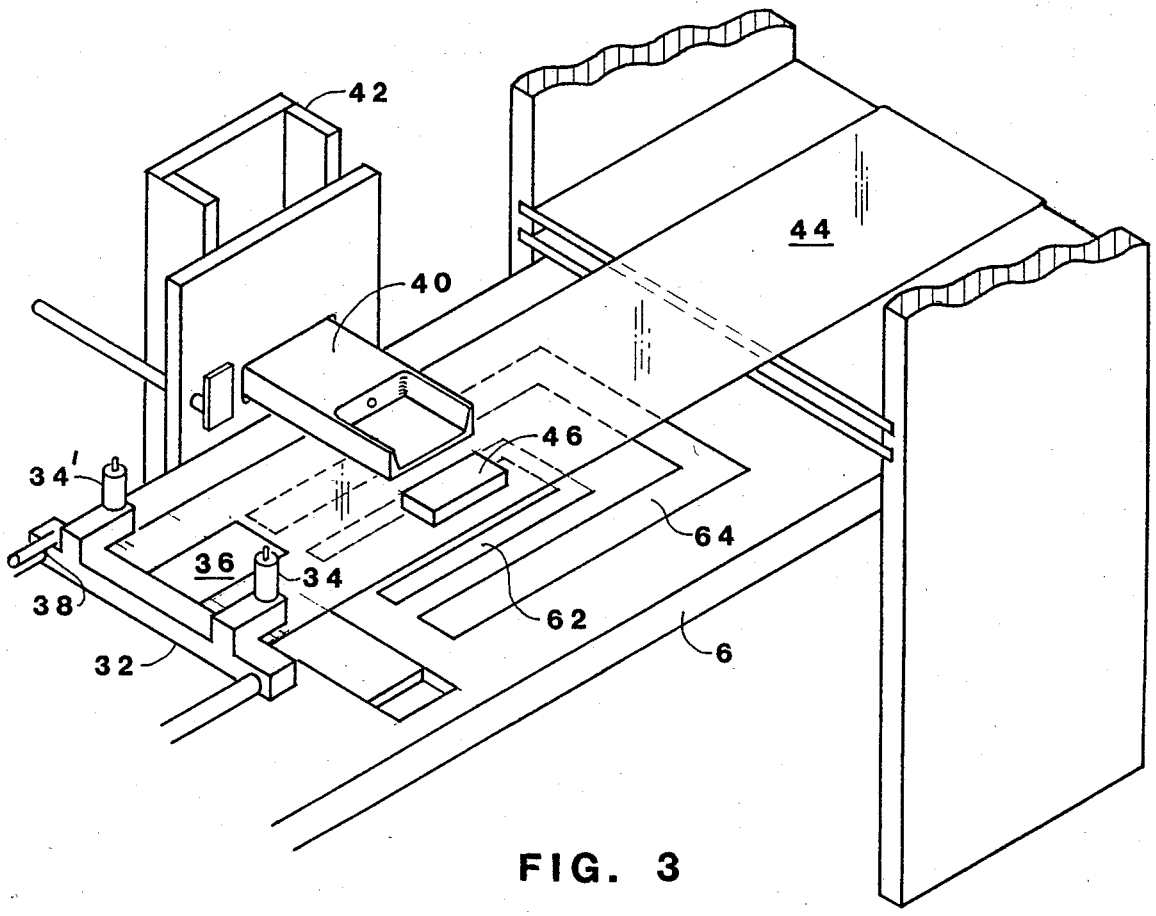

In FIG. 3 the grippers 34, 34' have gripped the sheet of plastic, designated 44, and puller 32 has drawn it rearwardly across the work table 6. The tray 40 has then moved outwardly across the plastic sheet 44, and the article 46 has been deposited on the plastic.

Figure 4:
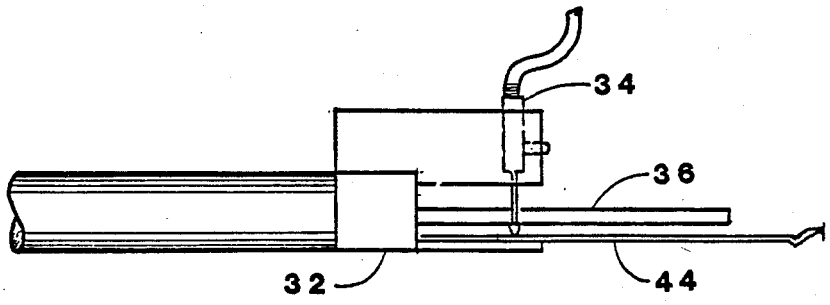
FIGS. 4 and 5 are, respectively, side and plan views of the pulling mechanism for a sheet of packaging material.
Figure 5:
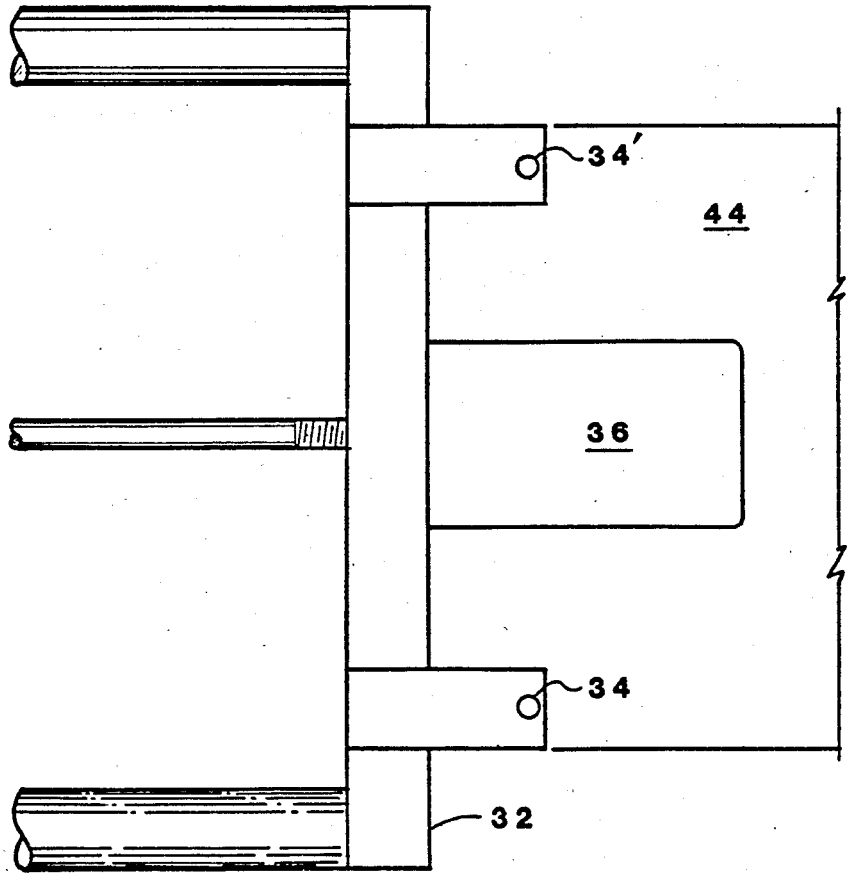
Figure 6:
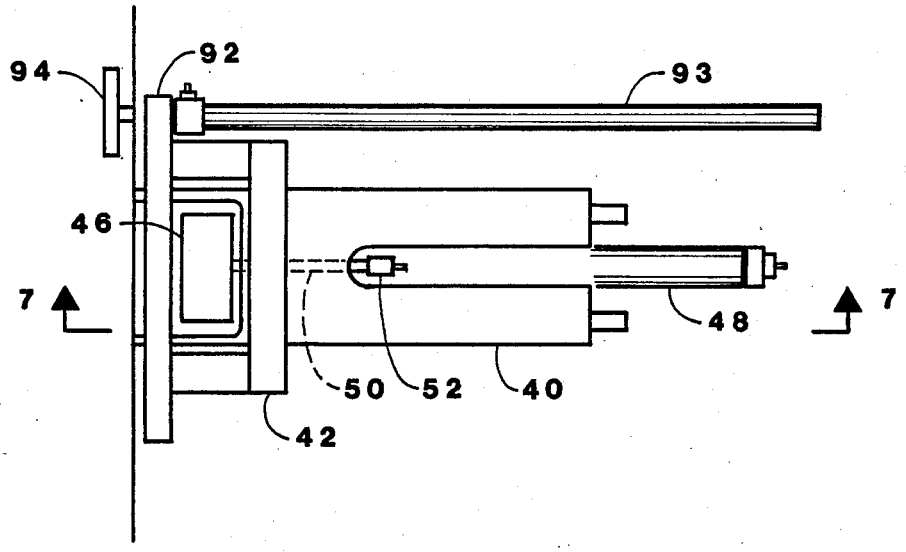
FIG. 6 is a plan view of the article loading mechanism in ready position.
Figure 7:
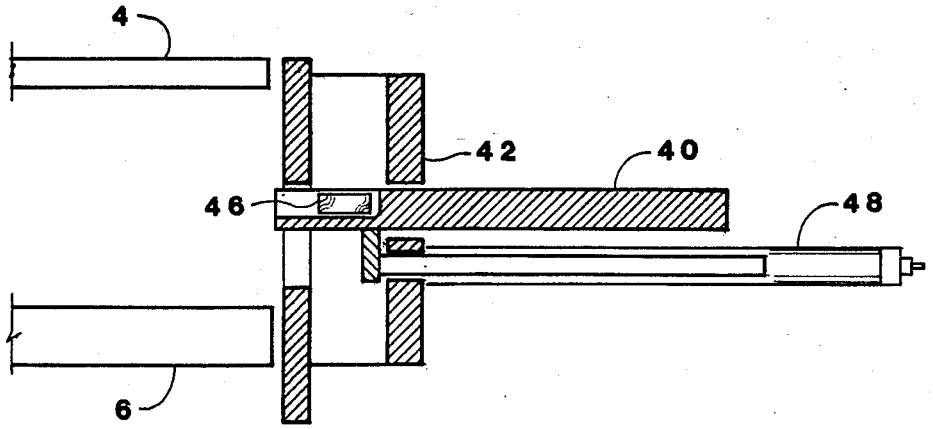
FIG. 7 is a section on the line 7,7 of FIG. 6.
Figure 8:
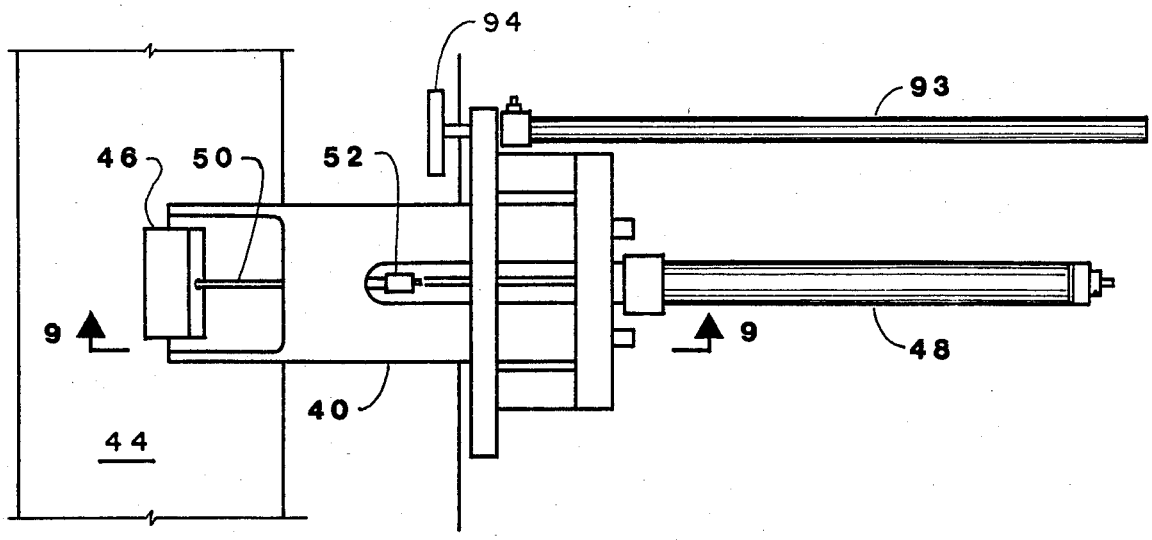
FIG. 8 is a plan view of the article loading mechanism in another position, depositing an article on a sheet of material.
Figure 9:
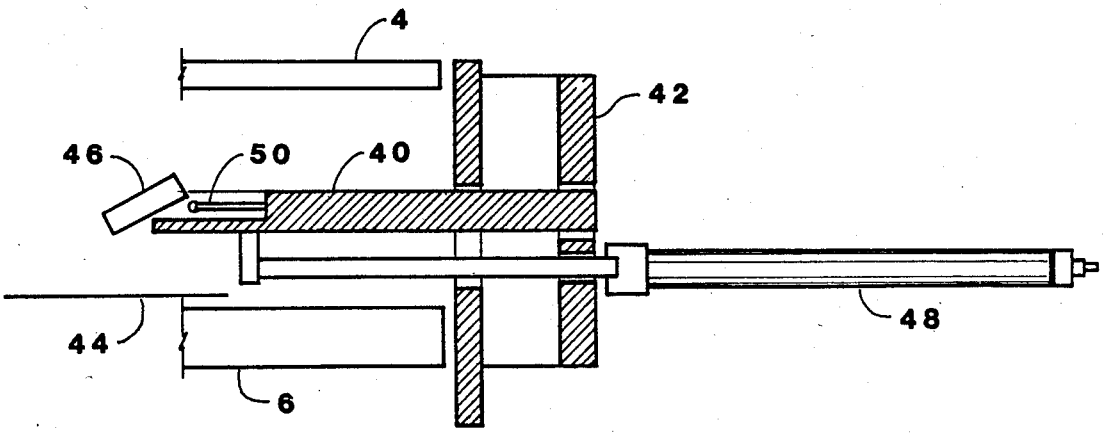
FIG. 9 is a section on the line 9,9 of FIG. 8.

These last operations are shown in more detail in FIGS. 4, 5, 6, 7, 8 and 9. FIGS. 4 and 5 show the grippers and air cylinders 34, 34' gripping the plastic 44 while the paddle 36 overlies the plastic. As shown in FIGS. 6 and 7, the loading tray 40 is moved inwardly and outwardly by an air cylinder 48. Ejector 50, operated by a small air cylinder 52, is provided to remove the article 46 from the tray and deposit it on the plastic. FIGS. 8 and 9 show this operation being accomplished. In these figures the tray 40 has been advanced outwardly by cylinder 48 and the ejector 50 has pushed the article 46 from the tray so that it will be positioned on the plastic 44 as shown in FIG. 3.

Figure 10:
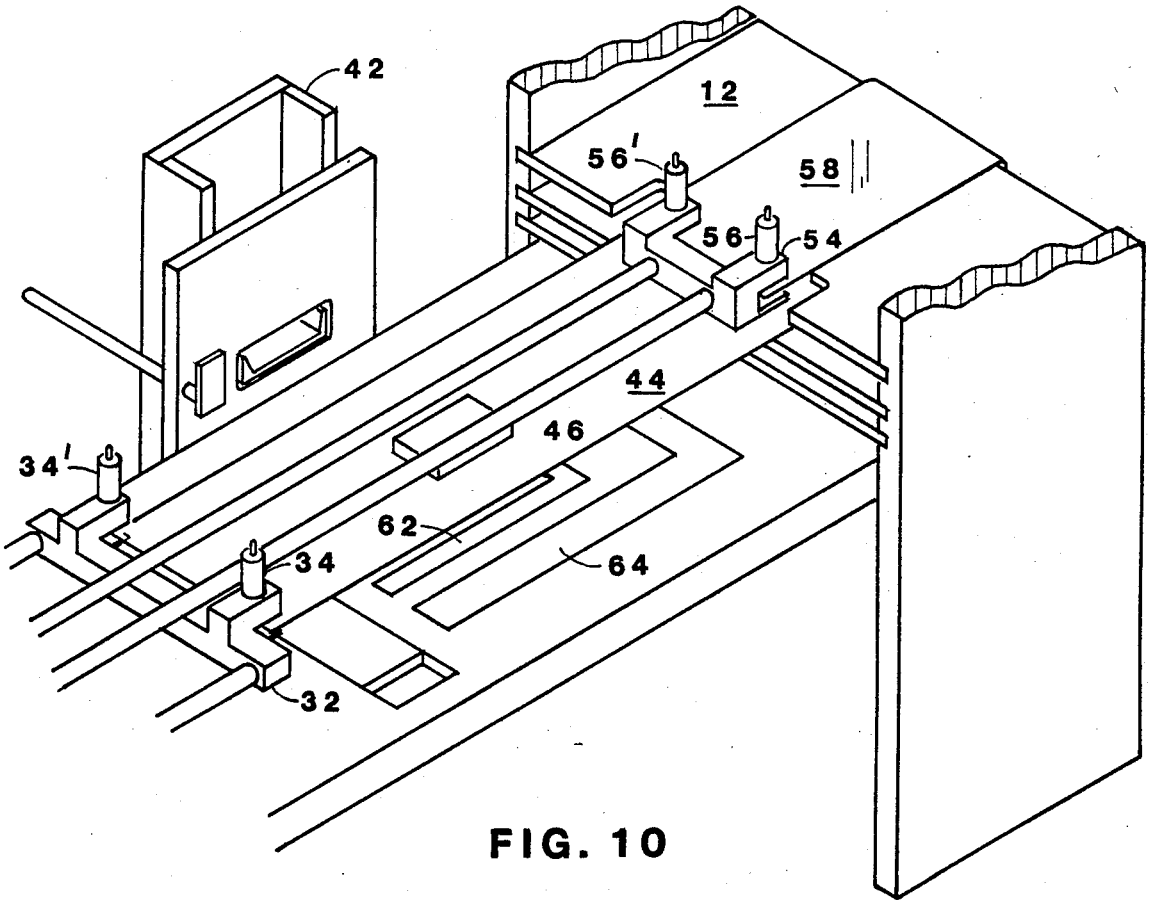
FIGS. 10 and 11 show, successively, the steps in drawing the next sheet of material.
Figure 11:
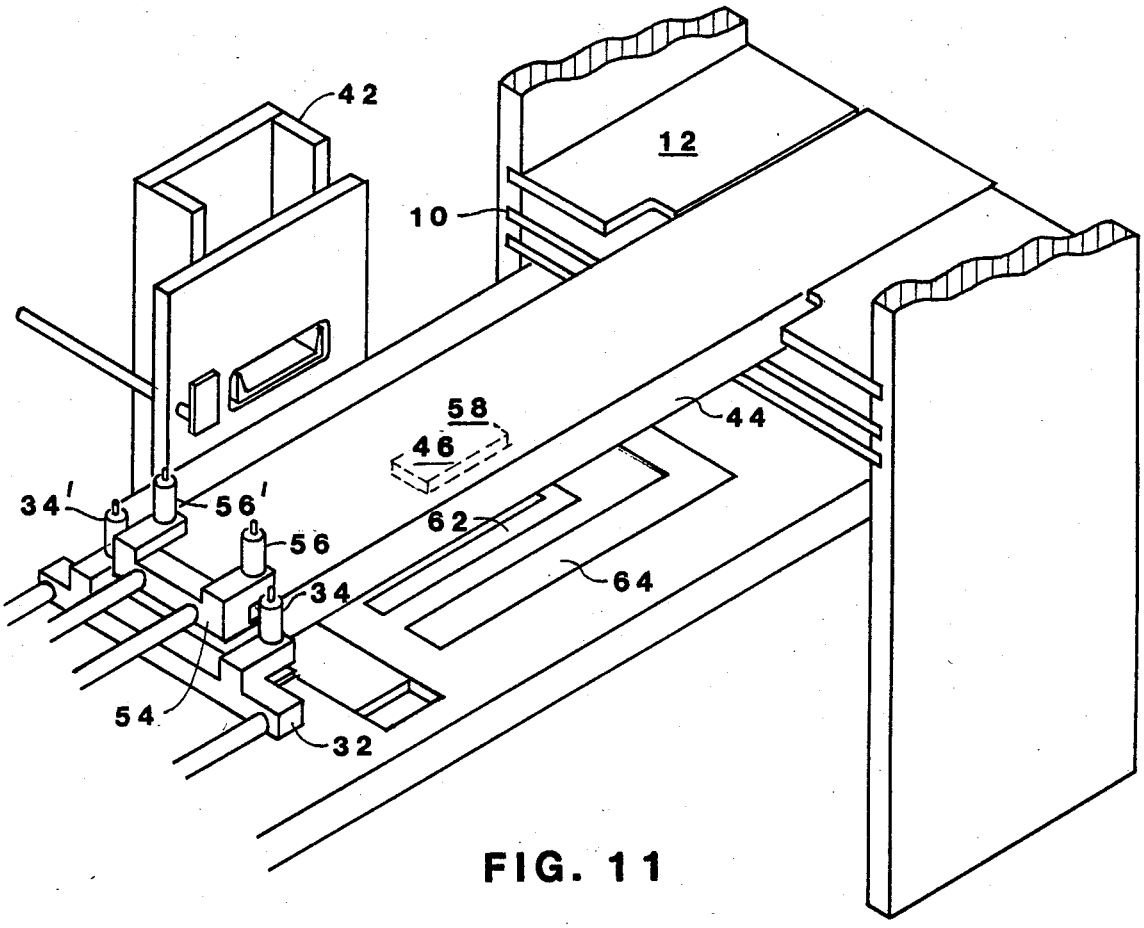

FIGS. 10 and 11 show the next step of the operation. In FIG. 10 the puller 54 carrying grippers 56, 56' has been advanced forwardly and is gripping the edge of sheet 58, which is on tray 12. This is the "2d sheet", using the terminology of the Summary. Article 46 is shown lying on the sheet 44. In FIG. 11 sheet 58 has been drawn rearwardly over sheet 44 and article 46, the latter being hidden.

Figure 12:
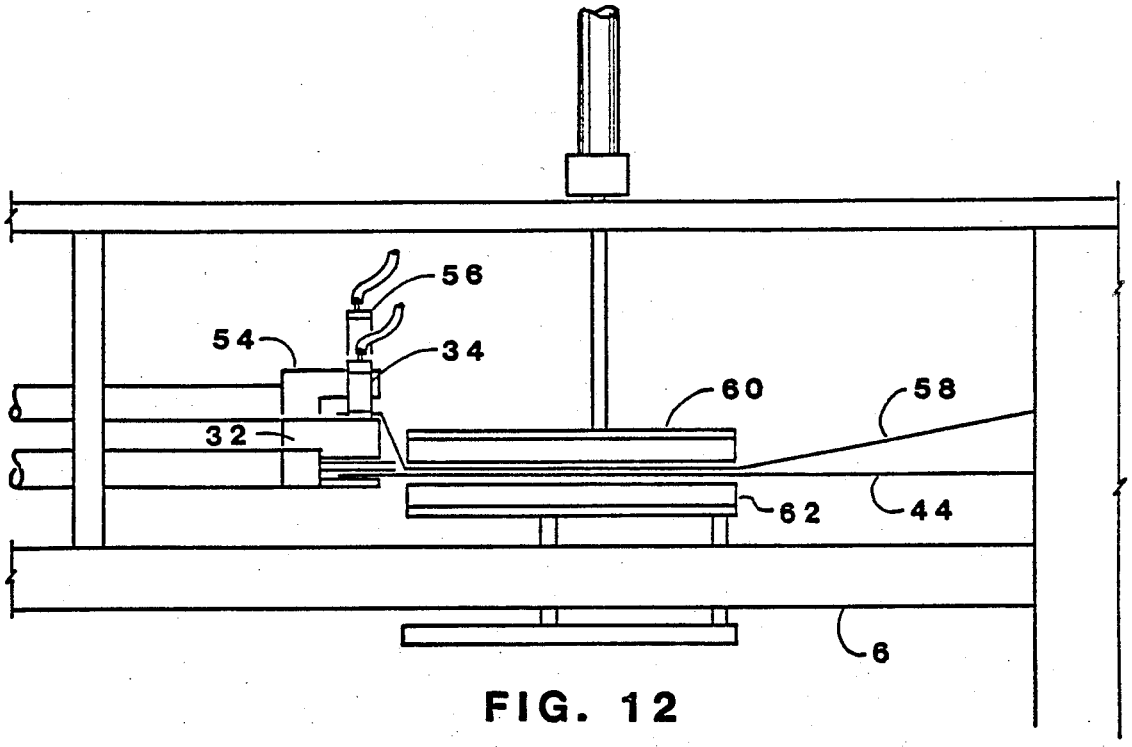
FIG. 12 is a side view showing the formation of a heat seal about the article to be packaged.
Figure 13:
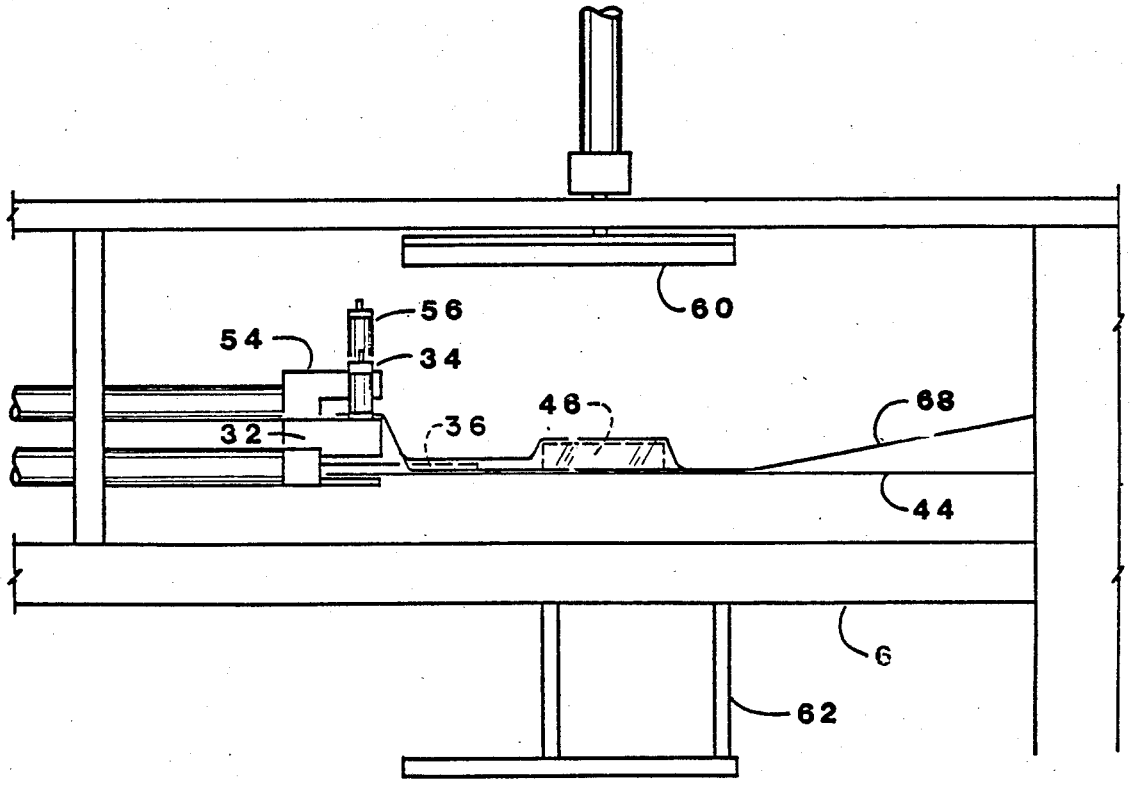
FIG. 13 shows the sealing means withdrawn after the seal has been made.

FIGS. 10 and 11 also show lower U-shaped heat-sealers 62 and 64. In FIG. 12 lower heat-sealer 62 and a mating upper heat-sealer 60 have been brought into engagement with plastic sheets 44 and 58, sealing them together. In FIG. 13 these heat-sealing means have been withdrawn so that the article 46 is now partially encased in between sheets 44 and 58.

Instead of being U-shaped, sealers 60 and 62 may include only the longitudinal portions. However, the U-shape better positions article 46.

Figure 14:
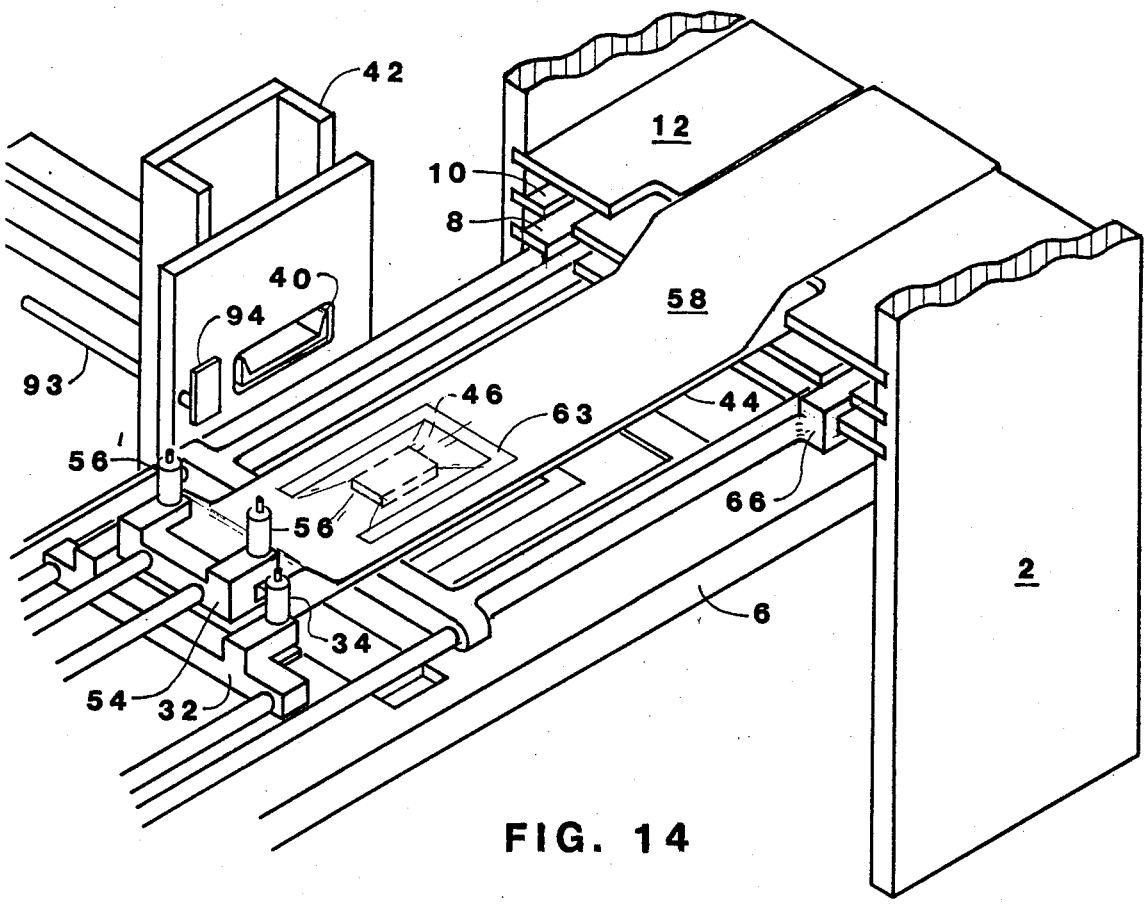
FIGS. 14 and 15 show, successively, the drawing of another sheet of material.
Figure 15:
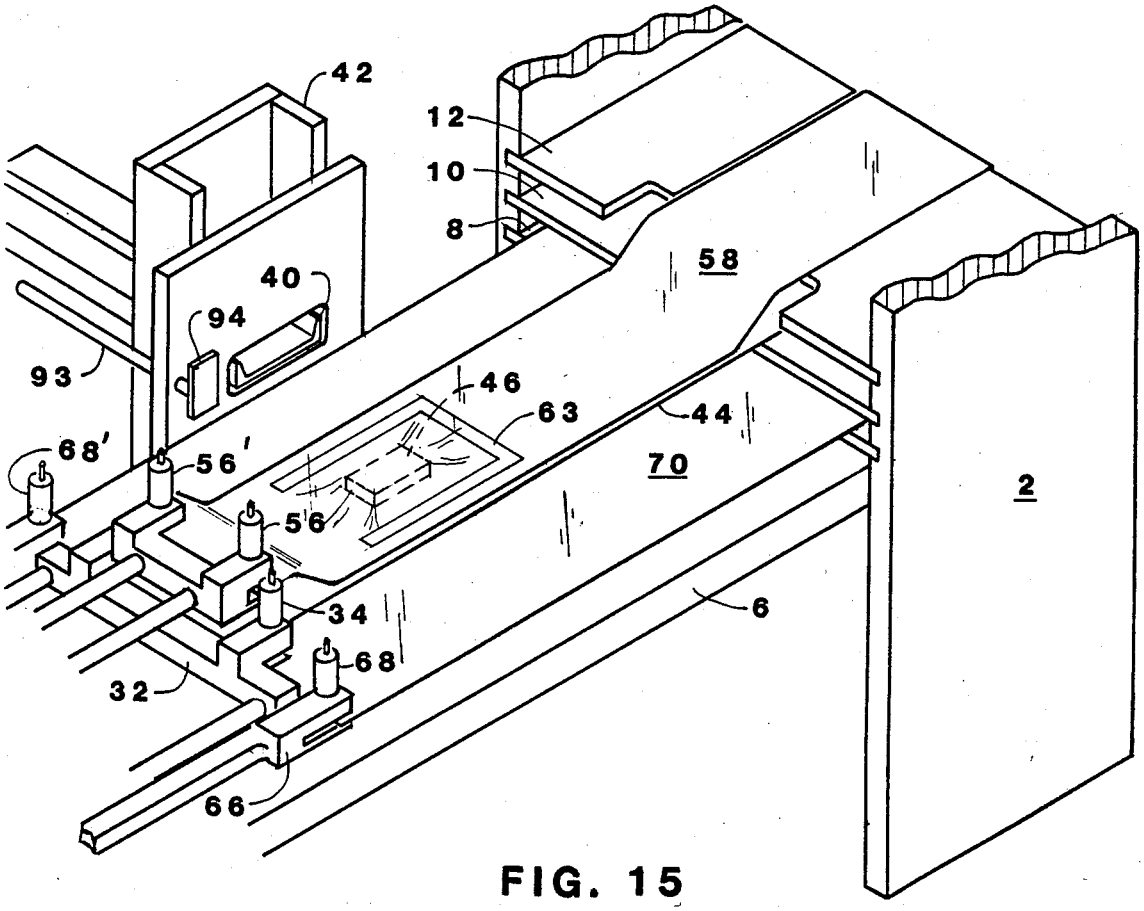

FIG. 14 shows an advance and FIG. 15 a retraction of a third puller 66 which carries grippers 68, 68' (shown in FIG. 15). These grip another sheet of plastic material 70 on tray 8, (the "4th sheet", using the terminology of the Summary). As shown in FIG. 15, sheet 70 is drawn beneath the two preceding sheets 44 and 59 and the article 46.

Figure 16:
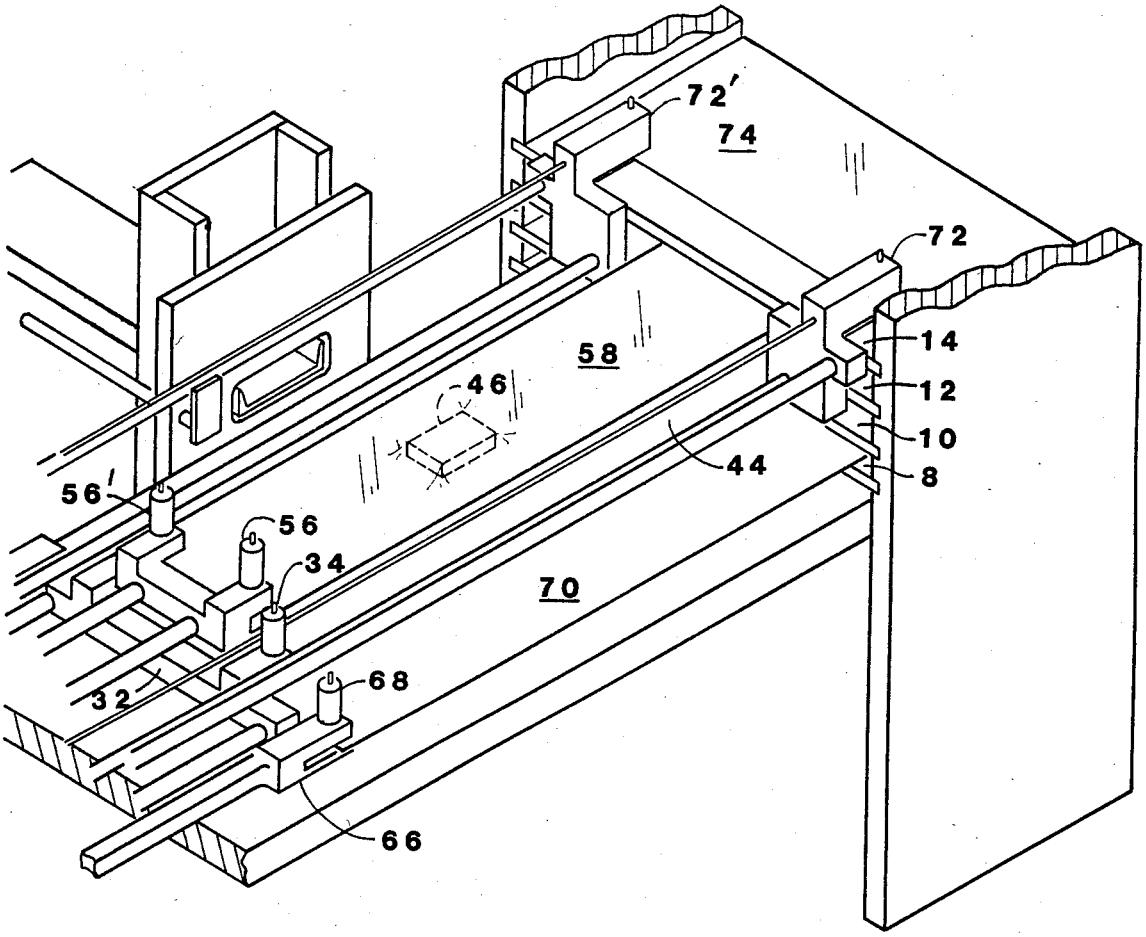
FIGS. 16 and 17 show the drawing of the final sheet of material.
Figure 17:
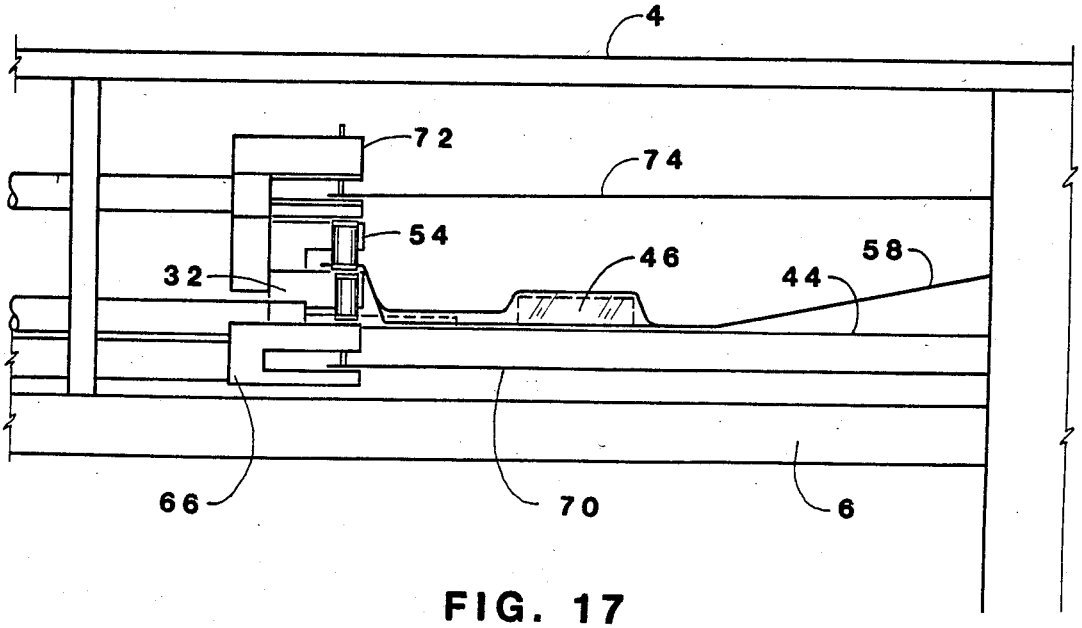

FIGS. 16 and 17 show, respectively, the advance and withdrawal of a fourth puller means, 72, 72'. These, like the previous pullers, carry grippers for gripping the plastic. (These are omitted, for convenience, on these views.) They grip the final sheet 74 of plastic (the "1st sheet", using the terminology of the Summary) on tray 14 and draw it rearwardly over the three sheets 44, 58 and 70 and the article 46 which was partially sealed between sheets 44 and 58.

Figure 18:
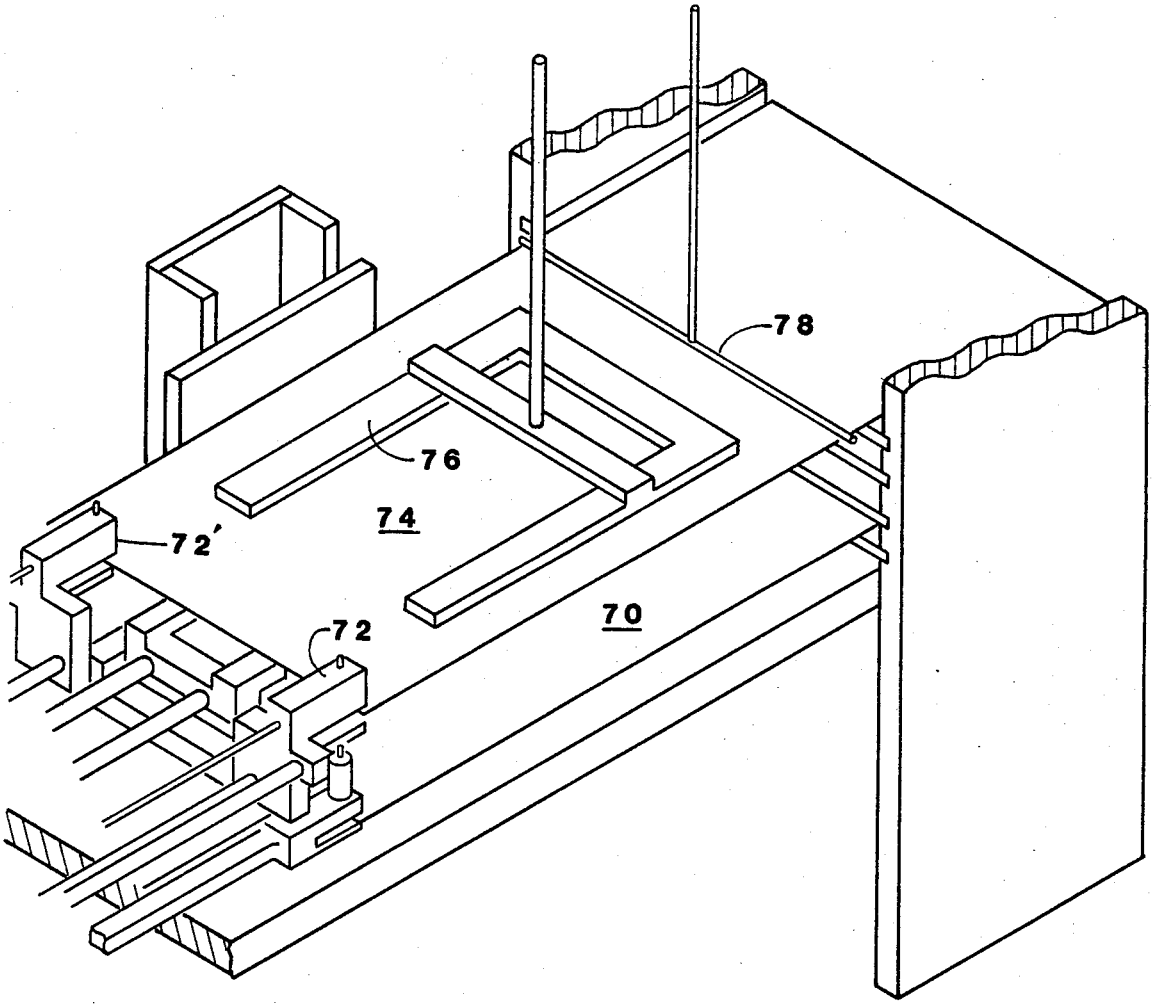
FIG. 18 is a perspective view showing a heat-sealing means in position to make another heat seal and cutting means in position to cut the sheets.

FIG. 18 shows in perspective 1st and 4th sheets 74 and 70, respectively, the puller means 72, 72' and heat-sealer 76, which is in position to seal these two sheets together. It will be noted that heat-sealer 76 has a U shape, mating with lower heat-sealer 64, FIGS. 10 and 11. FIG. 18 also shows a cutter 78 which is an electrically heated wire. (Alternatively, a knife could be used as the cutter.)

Figure 19:
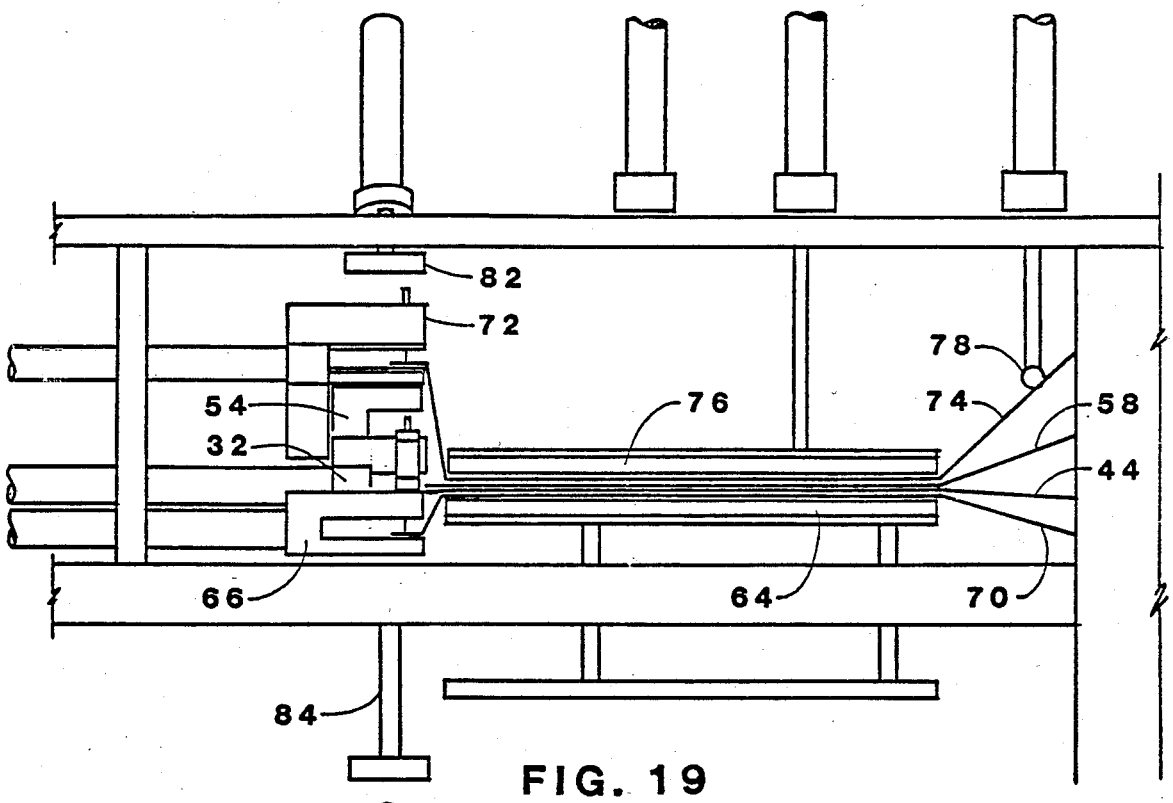
FIG. 19 is a side view showing the heat seal being made and the cutting means beginning to make the cut.

In FIG. 19 the heat-sealer 76 is shown cooperating with lower heat-sealer 64 to seal sheets 58, 44, 70 and 74 together and cutter 78 beginning to cut the sheets 74, 58, 44 and 70.

It will be noted in FIG. 19 that pulling means 72, 72', which hold sheet 74, puller 66, which holds sheet 70, puller 54, which holds sheet 58, and puller 32, which holds sheet 44 are in approximately the same longitudinal position.

Figure 20:
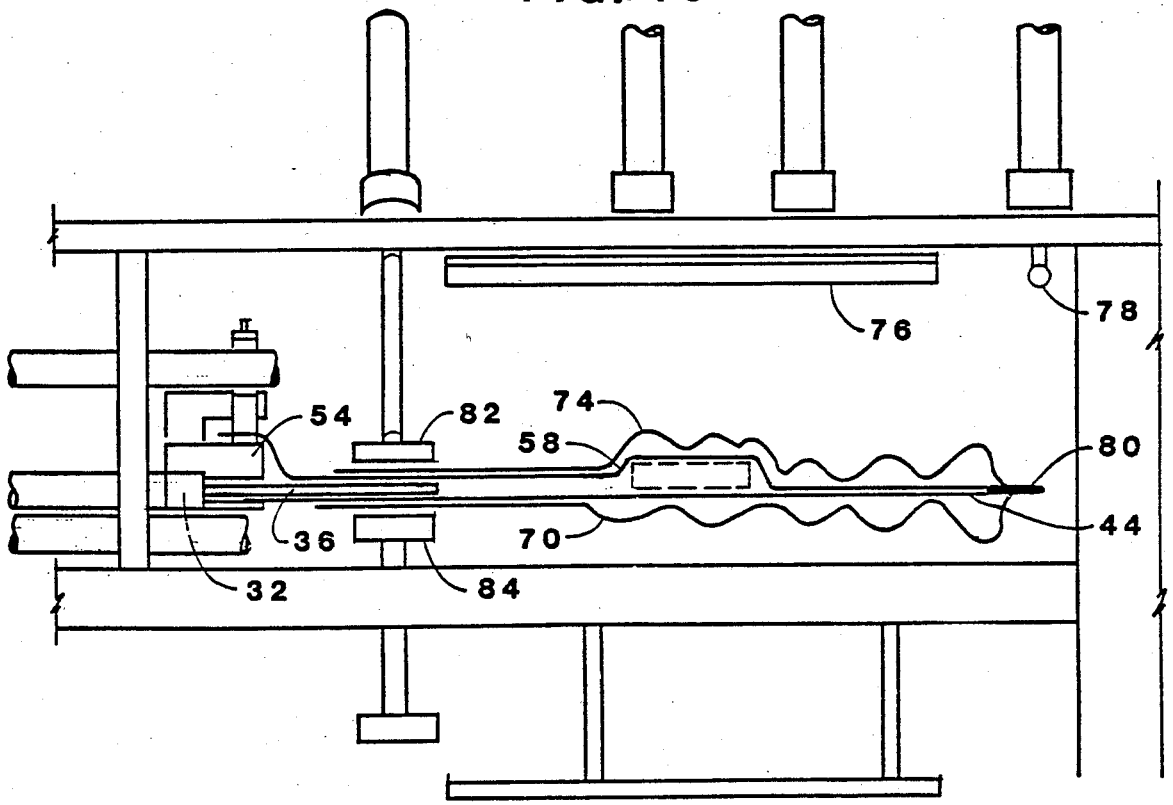
FIG. 20 is a side view showing adjustment of the positions of the sheets after they have been cut.

In FIG. 20 the heat-sealers 76 and 64 (not shown) and cutter 78 have been withdrawn. The cutter 78 has cut through all four sheets at the edge of trays 8, etc. and has been withdrawn, and pullers 32 and 54, which hold sheets 44 and 58, respectively, have been withdrawn rearwardly (to the left in FIG. 20). Puller 66, which holds sheet 70, and pulling means 72, 72', which hold sheet 74, have remained stationary. (These last two pullers are omitted for clarity.) This has drawn the two inner sheets 58 and 44 partially out from between the rearward edges of outer sheets 74 and 70. Since all four sheets are sealed together at their forward end 80, this has wrinkled sheets 74 and 70 as shown. The paddle 36 is shown positioned between the inner sheets 44 and 58. Upper and lower heat-sealers 82 and 84, respectively, are shown ready to make a transverse seal. When they are pressed together the 1st and 4th sheets 74 and 70 are sealed to each other and to the inner sheets 58 and 44. The latter two sheets, however, are held apart by paddle 36 and so are not sealed to each other.

Figure 21:
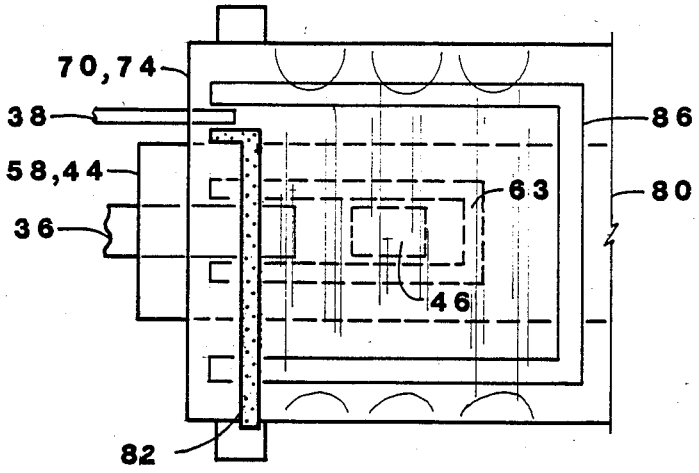
FIG. 21 is a plan view showing the next heat-sealing step.

FIG. 21 shows a plan view during this sealing step. Transverse sealer 82 and the corresponding lower transverse sealer 84 (not shown in this view) do not extend quite the full distance across the ends of the U-shaped seal 86, which was formed by sealers 76 and 64, but stop short of the fluid inlet tube 38. The resulting seal is shown at 88 in FIGS. 22 and 23. It is important that seal 88 intersect seals 86 and 63, so that an outer and an inner envelope are formed.

Figure 22:
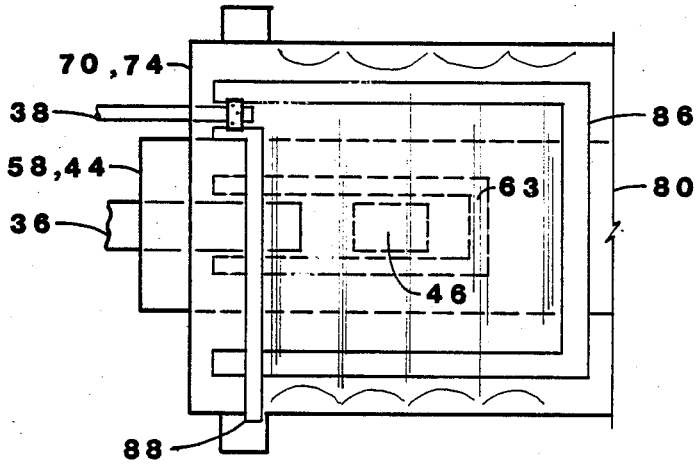
FIG. 22 is a plan view showing the inflation step.
Figure 23:
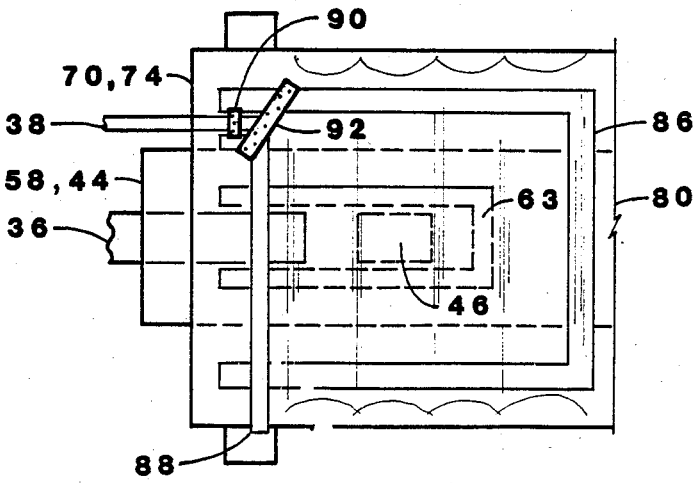
FIG. 23 is a plan view showing the final heat-sealing steps.

In FIG. 22 a resilient temporary sealer 90 has been pressed down over the fluid supply tube 38 and seals 86 and 63 to prevent leakage around the tube. Expandable fluid is then introduced to this tube, inflating the outer envelope formed by 1st and 4th sheets 70 and 74.

The final heat-sealer 92 (FIG. 23) then seals the opening that has been left, clearing the end of fluid supply tube 38. The grippers are then released.

Figure 24:
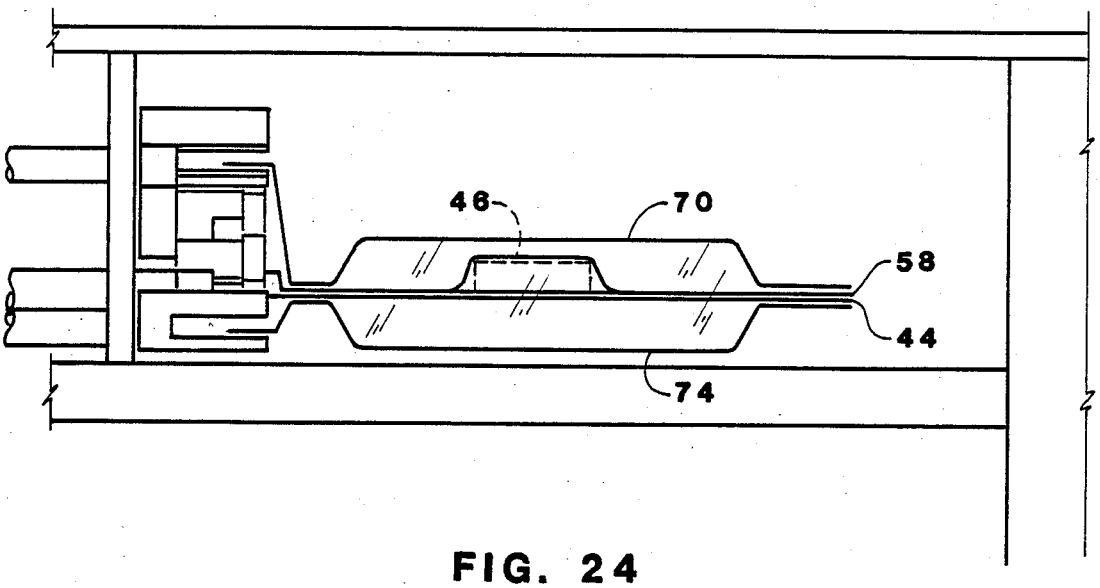
FIG. 24 is a side view of the package after the final seal.

The results of the inflation are shown in FIG. 24. Because of the adjustment of the positions of sheets 44 and 58 relative to the positions of sheets 70 and 74 shown in FIG. 20, the outer envelope formed by sheets 70 and 74 is larger in all directions than the inner envelope formed by sheets 58 and 44. This allows the sheets 70, 74 to expand, forming the outer envelope and stretching the inner envelope as shown in FIG. 24. At the same time the fact that the inner sheets 44, 58 have been prevented from being sealed to each other by paddle 36 allows them to expel air from between them, causing them to be collapsed tightly about the article 46. Since the grippers had all been released, the package formed is free.

Figure 25:
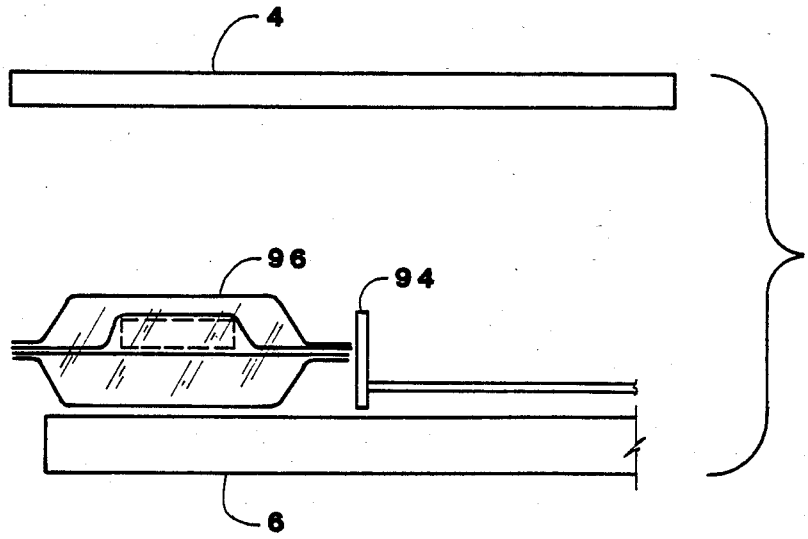
FIG. 25 is an end view showing the ejection of the package.

In FIG. 25 the ejector 94, operated by air cylinder 93 (FIG. 6), is shown pushing the completed package 97 from the table 6. This completes a sequence of operation. The pullers are all retracted and the sequence begins again.

Figure 26:
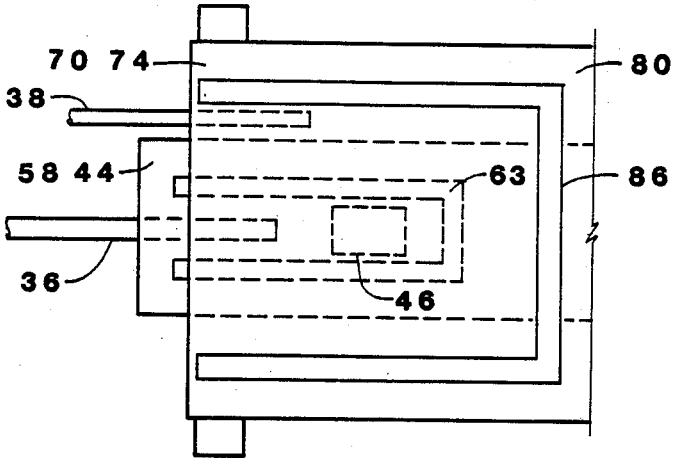
FIG. 26 is a plan view showing the first step in an alternate mode of inflation and final sealing.
Figure 27:
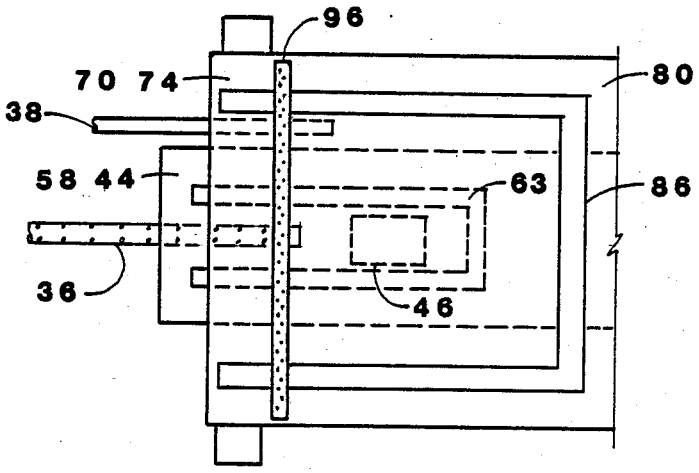
FIG. 27 is a plan view showing the alternate inflation step.
Figure 28:
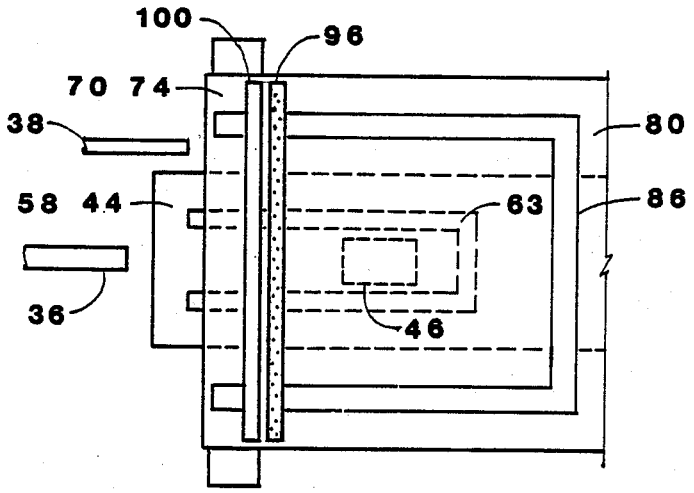
FIG. 28 shows the alternate final sealing step.

In FIGS. 26, 27 and 28 I show an alternate mode of inflation and final sealing. In this variation the fluid supply tube, indicated as 38', is made longer than tube 38 shown in FIG. 21. Paddle 36 is omitted, or may be replaced, if desired, by an air release tube 36'. This is not really necessary, however, and may be considered optional. In FIG. 27 a resilient member 96 has been shown pressed down on the plastic sheets. It extends completely across seal 86. However, it is so shaped that while it presses the upper and lower sheets 70, 74 tightly together and presses them onto the outer portions of inner sheets 58, 44, it does not press the latter two tightly together within seal 63. It will be noted that it also extends across the fluid supply tube 38'. Expandable fluid is now introduced through the latter, inflating the envelope formed by the outer sheets 70, 74 while collapsing the inner sheets 58, 44 together and expelling air from within the seal 63. The fluid supply tube 38 and the air release tube 36' (if used) are now withdrawn and simultaneously a heat sealer 100 is brought down and a mating heating sealer (not shown) beneath the sheets is brought up, sealing all four sheets together. Both the outer and inner envelopes are now sealed in this embodiment, but the inner envelope has been collapsed about the article 46.

As stated in the "Summary", the 2d and 3d sheets may be supplied in the form of a flattened tube, while the 1st and 4th sheets are in the form of separate flat strips. FIGS. 29 through 32 show modifications of the system already described for carrying out this variation of my method.

Figure 29:
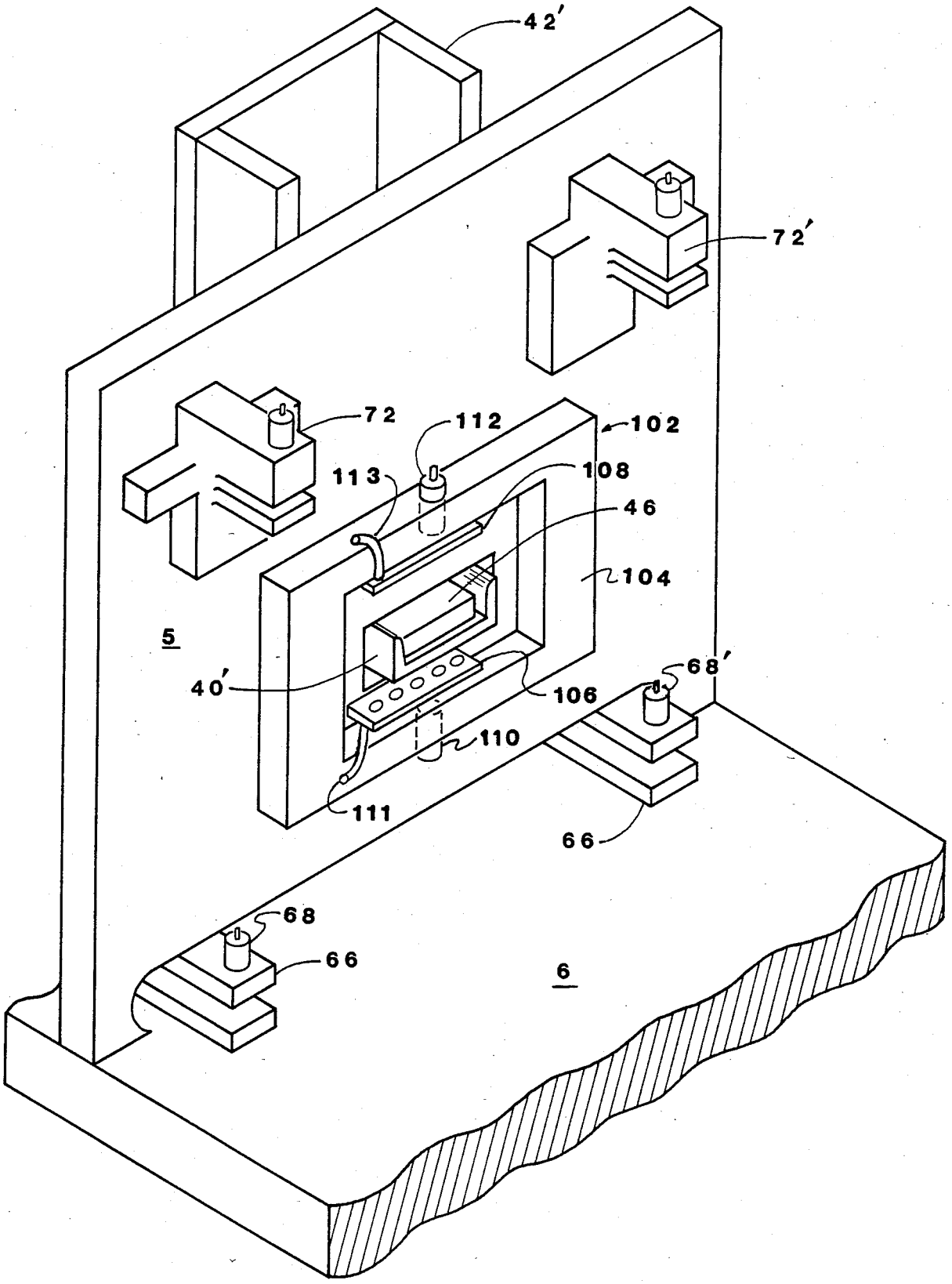
FIG. 29 is a perspective view, showing the pullers and feeding means, of a modification using a preformed tube to constitute the two narrower sheets.

Referring to FIG. 29, the puller 102, which replaces pullers 32 and 54 of my preferred embodiment, comprises a frame 104 which carries two suction plates 106, 108 and associated air cylinders 110, 112 and suction lines 111, 113.

That figure also shows stacking means 42' and article feed tray 40'. These last two elements are identical in structure and operation to stacking means 42 and feed tray 40, already described. It will be seen, however, that they are so positioned that feed tray 40' extends through wall 5 and through frame 104 of puller 102 when the latter is retracted.

Figure 30:
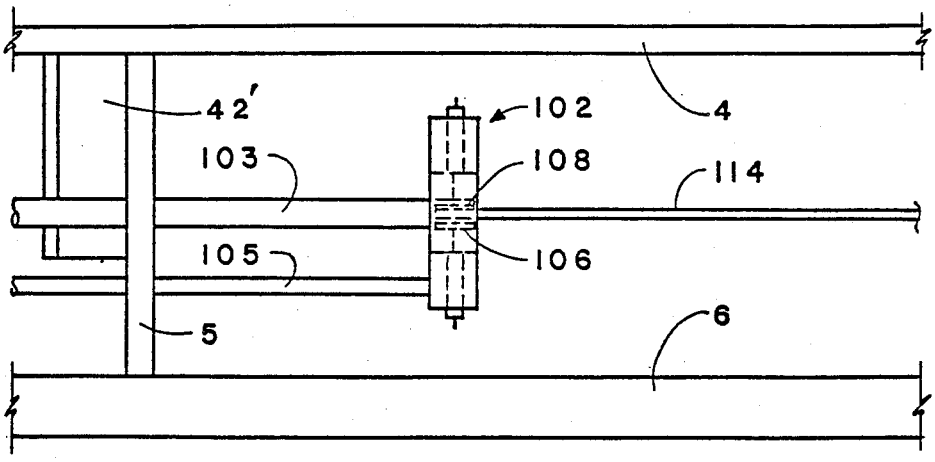
FIG. 30 is a side view showing the first step of drawing the tube into the working area.
Figure 31:
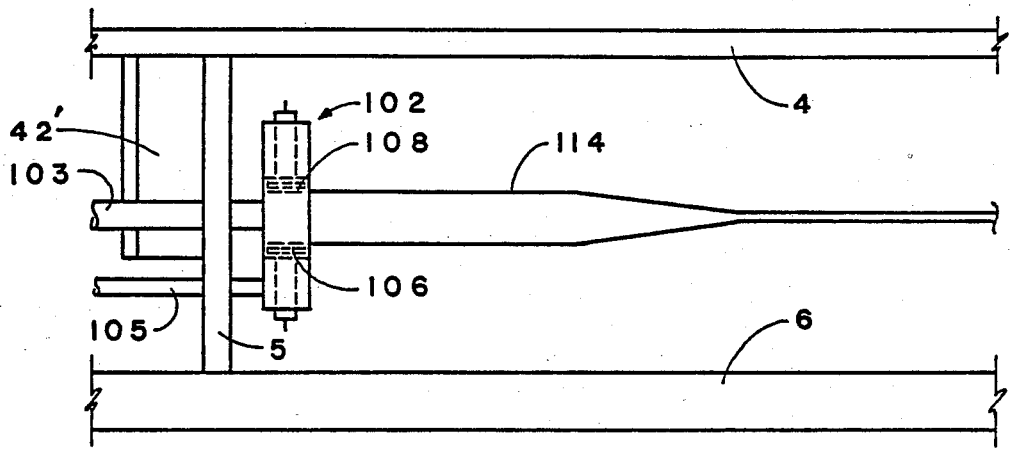
FIG. 31 is a side view showing the opening of the tube and the completion of the step of drawing it into the working area.
Figure 32:
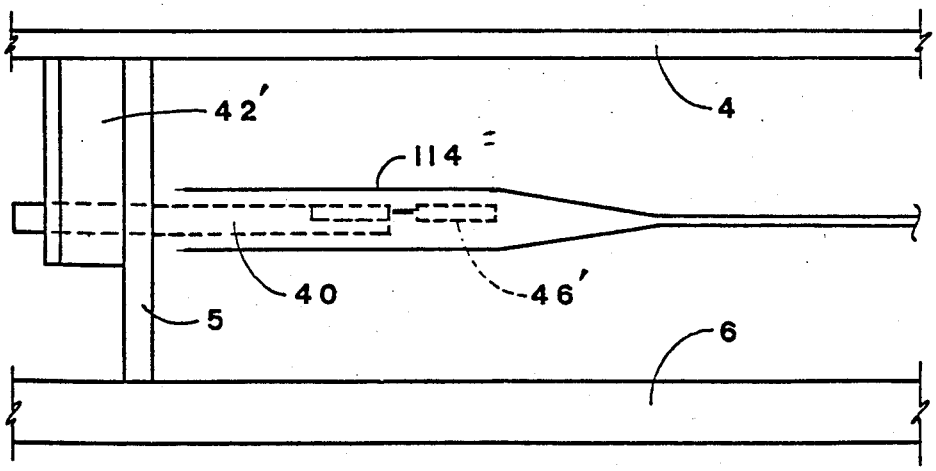
FIG. 32 is a side view showing the loading of the article into the tube.

The sequence of operations is shown diagrammatically in FIGS. 30, 31 and 32. In FIG. 30, the puller 102, carried by bearing rods 103 and air cylinder rod 105, has been moved forward and the suction plates 106, 108 have been pressed together to grip flattened preformed tube 114 and has been retracted rearwardly. In FIG. 31, puller 102 has been further retracted to an intermediate point corresponding to the position of all the pullers in FIGS. 18 and 19, suction has been applied to suction plates 106, 108 and they have been separated, opening the end of tube 114. In FIG. 32, wherein several parts have been omitted for clarity, feed tray 40' has been moved forwardly into tube 114 and an article 46 is being deposited by tray 40' into that tube.

Sealing about the article as described in connection with FIG. 12 may then take place. However, this step may be omitted if desired.

The remainder of the process follows as described in connection with FIGS. 14 through 28.

While I have described only the formation of a single envelope, it will be understood that, by the use of successively broader sheets, multiple envelopes might be formed which could be filled with different fluids.

While I have described my presently preferred embodiment in considerable detail, it will be apparent that various changes can be made, as discussed in the Summary. Moreover, while I have disclosed the use of heat-sealing, other methods of sealing could be used. I therefore wish my invention to be limited solely by the scope of the appended claims.

The embodiments of the invention in which a proprietary right or privilege is claimed are defined as follows:

1. A method of forming a package which comprises:

(a) providing a supply of sheets of material, each of said sheets having two parallel longitudinal edges and a free rear edge joining and substantially at right angles to said longitudinal edges;

(b) drawing longitudinally two sheets of material rearwardly from said free supply into a working area;

(c) sealing said sheets together longitudinally adjacent to their longitudinal edges if said edges are free;

(d) drawing longitudinally two additional sheets of said material from said supply rearwardly into said working area, said additional sheets being wider than said first-named sheets, while disposing said first-named sheets between said additional sheets;

(e) sealing said additional sheets together longitudinally adjacent to their edges if said edges are free, the seals thus produced being sufficiently spaced from the longitudinal edges of said first-named sheets to allow for fluid passage between the longitudinal edges of said first-named sheets and the longitudinal edges of said additional sheets;

(f) sealing said additional sheets together and to said first-named sheets in the forward portion of said working area;

(g) cutting, at a point forward of said transverse seal, any sheets which extend forwardly of said point; and (h) sealing said additional sheets together and to said first-named sheets transversely in the rear portion of said working area while maintaining said first-named sheets unsealed from each other over at least a portion of their width, and said additional sheets unsealed from each other over the same portion.

2. A method of packaging an article which comprises:

(a) providing a supply of sheets of material, each of said sheets having parallel longitudinal edges and a free rear edge joining and substantially at right angles to said longitudinal edges;

(b) drawing longitudinally two sheets of material from said supply rearwardly from said supply and placing an article between them;

(c) sealing said sheets together longitudinally adjacent to their longitudinal edges of said edges are free;

(d) drawing longitudinally two additional sheets rearwardly from said supply, said additional sheets being wider than said first-named sheets, while disposing said first-named sheets and said article between said additional sheets;

(e) sealing said additional sheets together longitudinally adjacent to their longitudinal edges if said edges are free, the seals thus produced being sufficiently spaced from the longitudinal edges of said first-named sheets to allow for fluid passage between the longitudinal edges of said first-named sheets and the longitudinal edges of said additional sheets;

(f) sealing said additional sheets together and to said first-named sheets transversely at a point forward of said article;

(g) cutting, at a point forward of said transverse seal, any sheets which extend forward of that point; and (h) introducing a fluid between said additional sheets but outside said first-named sheets while sealing said additional sheets together and to said first-named sheets rearwardly of said article under conditions such that said additional sheets are inflated and said first-named sheets are collapsed about said article, expelling any gas between them, said first-named sheets being left unsealed to each other over at least a portion of their width and said additional sheets being sealed to said first-named sheets, but not to each other, over the unsealed portion of said first-named sheets.

3. A method of forming a package as defined in claim 1 and, before step (h), adjusting the positions of the rear edges of said sheets so that the rear edges of the first-named sheets are positioned rearwardly of those of said last-named sheets.

4. A method of packaging an article as defined in claim 2 and, before step (h), adjusting the positions of the rear edges of said sheets so that the rear edges of the first-named sheets are positioned rearwardly of those of said last-named sheets.

5. A method of packaging an article utilizing superposed 1st, 2d, 3d, and 4th sheets of flat material, each of said sheets having two parallel, free longitudinal edges and a free rear edge joining and substantially at right angles to said longitudinal edges, the 2d and 3d sheets having substantially the same width, the 1st and 4th sheets being wider than the 2d and 3d sheets, comprising:

(a) drawing the 3d sheet rearwardly into a working area;

(b) depositing the article to be packaged on said 3d sheet;

(c) drawing the 2d sheet across said 3d sheet and said article;

(d) sealing said 2d and 3d sheets together longitudinally adjacent to their edges beside said article, but leaving at least a portion unsealed transversely rearward of said article;

(e) drawing the 1st and 4th sheets rearward above said 2d sheet and below said 3d sheet, respectively, to a point approximating the rear edges of said 2d and 3d sheets;

(f) sealing said 1st and 4th sheets together longitudinally adjacent to their edges and together and to said 2d and 3d sheets transversely, at a position forwardly of said article, the longitudinal seals thus produced being sufficiently spaced from the longitudinal edges of said 2d and 3d sheets to allow for fluid passage between the longitudinal edges of said 2d and 3d sheets and the longitudinal edges of said 1st and 4th sheets;

(g) cutting all of said sheets forwardly of the position where they are sealed together forwardly of said article;

(h) adjusting the relative positions of the rear portions of said sheets so that those of said 2d and 3d sheets are positioned rearwardly of those of said 1st and 4th sheets;

(i) sealing said 1st and 4th sheets together transversely outside the longitudinal edges of said 2d and 3d sheets, at a position rearwardly of said article except for a space allowed for inflation, and to said 2d and 3d sheets, respectively, while leaving the said 2d and 3d sheets unsealed to each other, the 1st and 4th sheets being unsealed to each other over the width of said 2d and 3d sheets;

(j) inflating the envelope formed by said 1st and 4th sheets;

(k) sealing said space allowed for inflation; and (l) removing the package thus formed from said working area.

6. Apparatus for forming a package comprising:

(a) means for supplying two superposed sheets of packaging material of extended length, each of said sheets having two parallel longitudinal edges and a free rear edge joining and substantially at right angles to said longitudinal edges;

(b) means for drawing a portion of said sheets rearwardly into a working area;

(c) sealing means constructed and arranged to seal said sheets together transversely at an intermediate position in the length of said working area;

(d) means for drawing two additional sheets of greater width than said first-named sheets, each of said sheets having two parallel free longitudinal edges and a free rear edge joining and substantially at right angles to said longitudinal edges;

(e) means for sealing said additional sheets together longitudinally adjacent to their longitudinal edges and transversely together and to said first-named sheets at a position forward of said intermediate position, said sealing means being so constructed and arranged that the longitudinal seals formed thereby are sufficiently widely spaced to allow for fluid passage between the longitudinal edges of said first-named sheets and the longitudinal edges of said additional sheets;

(f) means for cutting all of said sheets at a location forward of said first-named position;

(g) means for sealing the rearmost portions of said additional sheets together, but only outside the longitudinal edges of said first-named sheets, and to said first-named sheets; and (h) means for preventing said first-named sheets from being sealed together rearwardly of said intermediate position.

7. A method as defined in claim 2 wherein the fluid introduced in step (h) is an expandable fluid.

8. A method as defined in claim 2 wherein the fluid introduced in step (h) is a gas.

* * * * *